US005223338A

United States Patent [19]

Malhotra

[11] Patent Number: 5,223,338

[45] Date of Patent: Jun. 29, 1993

[54] COATED RECORDING SHEETS FOR WATER RESISTANT IMAGES

[75] Inventor: Shadi L. Malhotra, Mississauga, Canada

[73] Assignee: Xerox Corporation, Stamford, Conn.

[21] Appl. No.: 861,670

[22] Filed: Apr. 1, 1992

[51] Int. Cl.[5] ..... B41M 5/00

[52] U.S. Cl. ..... 428/342; 428/195; 428/474.4; 428/475.2; 428/511; 428/522; 428/914

[58] Field of Search ..... 428/195, 913, 914, 342, 428/211, 331, 341, 474.4, 475.2, 511, 522; 424/59, 47, 70; 524/555, 556

[56] References Cited

U.S. PATENT DOCUMENTS

| | | | |
|---|---|---|---|
| 4,157,388 | 6/1979 | Christiansen | 424/70 |
| 4,370,389 | 1/1983 | Ogura et al. | 428/511 |
| 4,396,453 | 8/1983 | Krankkala | 156/328 |
| 4,419,388 | 12/1983 | Suguyama et al. | 427/288 |
| 4,423,118 | 12/1983 | Carbett et al. | 428/514 |
| 4,576,867 | 3/1989 | Miyamoto | 428/342 |
| 4,719,282 | 1/1988 | Nadolsky et al. | 528/310 |
| 4,812,496 | 3/1989 | Leadbetter et al. | 524/47 |
| 4,830,911 | 5/1989 | Kojima et al. | 428/342 |
| 4,877,680 | 10/1989 | Sakaki et al. | 428/332 |

*Primary Examiner*—Patrick J. Ryan
*Assistant Examiner*—W. Krynsks
*Attorney, Agent, or Firm*—Judith L. Byorick

[57] ABSTRACT

A recording sheet comprising a substrate and a coating consisting essentially of an optional binder, an optional filler, and quaternary ammonium polymers selected from

I

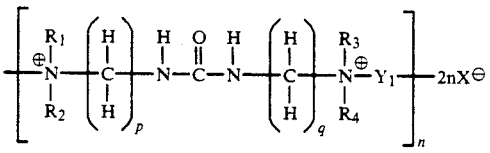

wherein n is an integer from 1 to 200, $R_1$, $R_2$, $R_3$, and $R_4$ are selected from alkyl, hydroxyalkyl, and polyoxyalkylene, p is an integer from 1 to 10, q is an integer from 1 to 10, X is an anion, and $Y_1$ is selected from $-CH_2CH_2OCH_2CH_2-$, $-CH_2CH_2OCH_2CH_2OCH_2CH_2-$, $-(CH_2)_k-$, wherein k is an integer from 2 to 10, and $-CH_2CH(OH)CH_2-$;

II

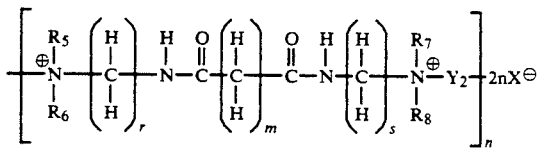

wherein wherein n is an integer from 1 to 200, $R_5$, $R_6$, $R_7$, and $R_8$ are selected from alkyl, hydroxyalkyl, and polyoxyalkylene, m is an integer from 0 to 40, r is an integer from 1 to 10, s is an integer from 1 to 10, X is an anion, and $Y_2$ is selected from $-CH_2CH_2OCH_2CH_2-$, $-CH_2CH_2OCH_2CH_2OCH_2CH_2-$, $-(CH_2)_k-$, wherein k is an integer from 2 to 10, and $-CH_2CH(OH)CH_2-$;

III

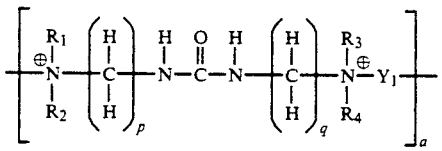

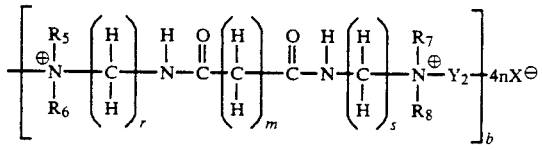

wherein a and b are integers wherein the sum of a+b is from 2 to 200, $R_1$, $R_2$, $R_3$, $R_4$, $R_5$, $R_6$, $R_7$, and $R_8$ are selected from alkyl, hydroxyalkyl, and polyoxyalkylene, p is an integer from 1 to 10, q is an integer from 1 to 10, X is an anion, and $Y_1$ and $Y_2$ are selected from $-CH_2CH_2OCH_2CH_2-$, $-CH_2CH_2OCH_2CH_2OCH_2CH_2-$, $-(CH_2)_k-$, wherein k is an integer from 2 to 10, and $-CH_2CH(OH)CH_2-$. Mixtures of these polymers are also suitable.

25 Claims, No Drawings

COATED RECORDING SHEETS FOR WATER RESISTANT IMAGES

BACKGROUND OF THE INVENTION

The present invention is directed to coated recording sheets. More specifically, the present invention is directed to recording sheets, such as paper, transparency, plastic, or the like, coated with a quaternary ammonium polymer. One embodiment of the present invention is directed to a recording sheet which comprises a substrate and a coating consisting essentially of (1) quaternay ammonium polymers selected from the group consisting of (a) polymers of Formula I

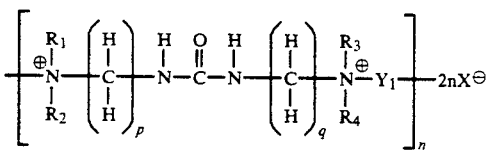

I wherein n is an integer of from 1 to about 200, $R_1$, $R_2$, $R_3$, and $R_4$ are each independently selected from the group consisting of alkyl groups, hydroxyalkyl groups, and polyoxyalkylene groups, p is an integer of from 1 to about 10, q is an integer of from 1 to about 10, X is an anion, and $Y_1$ is selected from the group consisting of $—CH_2CH_2OCH_2CH_2—$, $—CH_2CH_2OCH_2CH_2OCH_2CH_2—$, $—(CH_2)_k—$, wherein k is an integer of from about 2 to about 10, and $—CH_2CH(OH)CH_2—$(b) polymers of Formula II

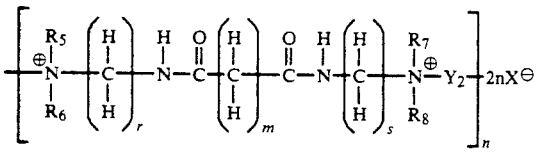

II wherein wherein n is an integer of from 1 to about 200, $R_5$, $R_6$, $R_7$, and $R_8$ are each independently selected from the group consisting of alkyl groups, hydroxyalkyl groups, and polyoxyalkylene groups, m is an integer of from 0 to about 40, r is an integer of from 1 to about 10, s is an integer of from 1 to about 10, X is an anion, and $Y_2$ is selected from the group consisting of $—CH_2CH_2OCH_2CH_2—$, $—CH_2CH_2OCH_2CH_2OCH_2CH_2—$, $—(CH_2)_k—$, wherein k is an integer of from about 2 to about 10, and $—CH_2CH(OH)CH_2—$; (c) copolymers of Formula III

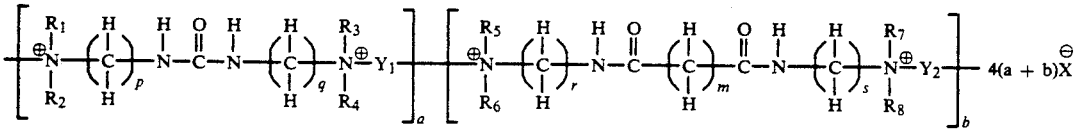

III wherein a and b are each integers wherein the sum of a+b is from about 2 to about 200, $R_1$, $R_2$, $R_3$, $R_4$, $R_5$, $R_6$, $R_7$, and $R_8$ are each indendently selected from the group consisting of alkyl groups, hydroxyalkyl groups, and polyoxyalkylene groups, p is an integer of from 1 to about 10, q is an integer of from 1 to about 10, X is an anion, and $Y_1$ and $Y_2$ are each independently selected from the group consisting of $—CH_2CH_2OCH_2CH_2—$, $—CH_2CH_2OCH_2CH_2OCH_2CH_2—$, $—(CH_2)_k—$, wherein k is an integer of from about 2 to about 10, and $—CH_2CH(OH)CH_2—$; (d) mixtures of polymers of Formula I and polymers of Formula II; (e) mixtures of polymers of Formula I and copolymers of Formula III; (f) mixtures of polymers of Formula II and copolymers of Formula III; and (g) mixture of polymers of Formula I, polymers of Formula II, and copolymers of Formula III; (2) an optional binder polymer; and (3) an optional filler.

U.S. Pat. No. 4,370,389 (Ogura et al.) discloses coated paper having a high paper gloss and a surface strength sufficient for practical purposes obtained by coating a base paper sheet with an aqueous coating composition comprising a paper-coating pigment and a latex of styrenebutadiene copolymer or modified styrenebutadiene copolymer, the styrene block of which includes 8 to 40 monomeric units, drying the wet coated sheet, and subjecting the coated side to hot calendering treatment.

U.S. Pat. No. 4,396,453 (Krankkala) discloses an aqueous starchbased adhesive comprising (a) water, (b) corn starch or wheat starch, (c) a carboxylated styrenebutadiene latex, (d) a thickener, and (e) a crosslinking agent. The thickener and crosslinking agent are collectively present as a minor component. A preferred thickener is a mixture of hydroxyethylcellulose and ammonia and the preferred crosslinking agent is a mixture of a ureaformaldehyde resin and glyoxal. The adhesive has a solids content of between about 35 and about 50 weight percent and pH ranging from about 4.5 to 7.0. The aqueous adhesive can be used to manufacture corrugated paperboard.

U.S. Pat. No. 4,423,118 (Corbett et al.) discloses a coating composition comprising an aqueous dispersion of a pigment such as clay and a binder such as a latex of a copolymer of styrene and butadiene thickened with a water-soluble copolymer of an $\alpha,\beta$-ethylenically unsaturated carboxylic acid such as acrylic acid, an ethylenically unsaturated carboxamide such as acrylamide, and an ethylenically unsaturated monomer having limited solubility in water such as acrylonitrile. The coating composition is effectively employed in coating paper and other cellulosic web materials.

U.S. Pat. No. 4,812,496 (Leadbetter et al.) discloses an adhesive of starch and an ammonium-based latex which imprives wet-pin adhesion for paperboard and corrugated board. The latexes are typical styrenebutadiene and carboxylated styrene-butadiene latexes but are polymerized in the presence of a volatile base such as ammonium hydroxide.

U.S. Pat. No. 4,576,867 (Miyamoto) discloses an ink jet recording paper having attached at least to its surface a cationic resin of the formula

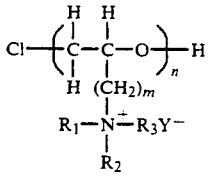

wherein $R_1$, $R_2$, and $R_3$ represent alkyl group, m represents a number of 1 to 7, n represents a number of 2 to 20, and Y represents an acid residue.

U.S. Pat. No. 4,830,911 (Kojima et al.) discloses a recording sheet for ink jet printers which gives an image by the use of an aqueous ink containing a water-soluble dye, coated or impregnated with either of or a mixture of two kinds of water soluble polymers, one whose polymeric unit is alkylquaternaryammonium (meth)acrylate and the other whose polymer unit is alkylquaternaryammonium (meth)acrylamide, wherein the water soluble polymers contain not less than 50 mol percent of a monomer represented by the formula

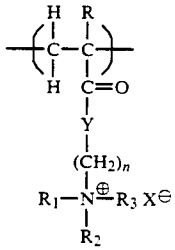

where R represents hydrogen or methyl group, n is an interger from 1 to 3 inclusive, $R_1$, $R_2$, and $R_3$ represent hydrogen or the same or different aliphatic alkyl group with 1 to 4 carbon atoms, X represents an anion such as a halogen ion, sulfate ion, alkyl sulfate ion, alkyl sulfonate ion, aryl sulfonate ion, and acetate ion, and Y represents oxygen or imino group.

U.S. Pat. No. 4,419,388 (Sugiyama et al.) discloses a waterproofing method for an ink jet record in a method of recording images on a recording sheet by an ink jet recording method using aqueous ink, comprising forming or applying, on at least the imaged portion of the recording sheet after forming images thereon, a compound represented by the formula $M^{I}M^{III}(X()_4)_3 12\text{-}H_2O$, wherein $M^{I}$ represents a monovalent metal atom or an ammonium group, $M^{III}$ represents a trivalent metal atom, and X represents a sulfur atom or a selenium atom.

U.S. Pat. No. 4,877,680 (Sakaki et al.) discloses a recording medium comprising a substrate and a nonporous ink receiving layer. The ink receiving layer contains a water-insoluble polymer containing a cationic resin. The recording medium may be employed for recording by attaching droplets of a recording liquid thereon.

U.S. Pat. No. 4,719,282 (Nadolsky et al.), the disclosure of which is totally incorporated herein by reference, discloses polycationic block copolymers useful as antistatic agents in detergent formulations and as flocculating agents. The compounds are formed by first forming a block of units by reacting a monomer of the formula

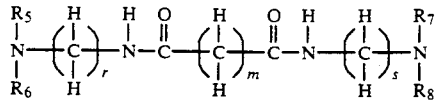

wherein each of $R_5$, $R_6$, $R_7$, and $R_8$ may be the same or different and is selected from the group consisting of $C_{1-3}$ alkyl, $C_{1-3}$ hydroxy alkyl, and polyoxyalkylene, m is an integer from 0 to 34, and r and s are the same or different and are integers from 1 to 6, with a molar excess of a dihalide of the formula Hal—L—Hal, wherein Hal represents a halogen atom and L is selected from $—CH_2CH_2—O—CH_2CH_2—$, $—CH_2CH_2—O—CH_2CH_2—O—CH_2—$, $—(CH_2)_t—$, and $—CH_2CHOHCH_2—$, where t is an integer from 2 to 6, and thereafter reacting the product so formed with a compound of the formula

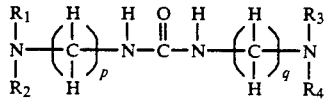

wherein $R_1$, $R_2$, $R_3$, and $R_4$ are each individually selected from the group consisting of $C_{1-3}$ alkyl, $C_{1-3}$ hydroxy alkyl, and polyoxyalkylene, and p and q are each individually integers of from 1 to 6, and, if necessary, reacting the product with further compound of the formula Hal—L—Hal.

U.S. Pat. No. 4,157,388 (Christiansen), the disclosure of which is totally incorporated herein by reference, discloses polycationic or polyquaternary ammonium ionenes which generally are hygroscopic, and processes for their preparation. The compounds are useful as conditioning agents for skin, hair, textile products, and powders.

Copending application U.S. Ser. No. 07/616,466, entitled "Coated Receiver Sheets," filed Nov. 21, 1990, disclosed a receiver sheet which comprises a substrate and a coating which comprises a pigment and a binder comprising polyvinyl alcohol and an additional binder component selected from the group consisting of styrene-butadiene latices, cationic polyamines, cationic polyacrylamides, cationic polyethyleneimines, styrene-vinyl pyrrolidone copolymers, styrene-maleic anhydride copolymers, polyvinyl pyrrolidone, vinyl pyrrolidone-vinyl acetate copolymers, and mixtures thereof. When the receiver sheet is a coated paper, the paper substrate has a Hercules sizing degree of at least about 50 seconds and a basis weight of less than about 90 grams per square meter. When the receiver sheet is a transparency, the substrate is substantially transparent. The receiver sheet is particularly suitable for printing with aqueous based inks, such as those employed in ink jet printing systems.

Copending application U.S. Ser. No. 07/469,985, entitled "Treated Papers," filed Jan. 25, 1990, discloses a paper which comprises a supporting substrate with a coating comprising (a) a desizing component selected from the group consisting of (1) hydrophilic poly(dialkylsiloxanes); (2) poly(alkylene glycol); (3) poly(propylene oxide)-poly(ethylene oxide) copolymers; (4) fatty ester modified compounds of phosphate, sorbitan, glycerol, poly(ethylene glycol), sulfosuccinic acid, sulfonic acid and alkyl amine; (5) poly(oxyalkylene) modified compounds of sorbitan esters, fatty amines, alkanol amides, castor oil, fatty acids and fatty alcohols; (6) quaternary alkosulfate compounds; (7) fatty imidazolines; and mixtures thereof, and (b) a hydrophilic binder polymer. The binder polymer may be a quaternary ammonium copolymer such as Mirapol WT, Mirapol AD-1, Mirapol AZ-1, Mirapol A-15, Mirapol-9, Merquat-100, or Merquat-550, available from Miranol Incorporated.

Although known compositions and processes are suitable for their intended purposes, a need remains for improved coated receiver sheets. In addition, there is a need for receiver sheets suitable for use both in ink jet printing processes and in electrophotographic copying and printing processes. Further, there is a need for receiver sheets which enable improved waterfastness of images printed thereon. Additionally, a need exists for receiver sheets suitable for color printing and copying by either ink jet or electrophotographic processes. There is also a need for receiver sheets which exhibit reduced static charge. In addition, there is a need for receiver sheets which enable formation of images with high optical densities.

SUMMARY OF THE INVENTION

It is an object of the present invention to provide improved coated receiver sheets with the above noted advantages.

It is another object of the present invention to provide receiver sheets suitable for use both in ink jet printing processes and in electrophotographic copying and printing processes.

It is yet another object of the present invention to provide receiver sheets which enable improved waterfastness of images printed thereon.

It is still another object of the present invention to provide receiver sheets suitable for color printing and copying by either ink jet or electrophotographic processes.

Another object of the present invention is to provide receiver sheets which exhibit reduced static charge.

Yet another object of the present invention is to provide receiver sheets which enable formation of images with high optical densities.

These and other objects of the present invention (or specific embodiments thereof) can be achieved by providing a recording sheet which comprises a substrate and a coating consisting essentially of (1) quaternary ammonium polymers selected from the group consisting of (a) polymers of Formula I

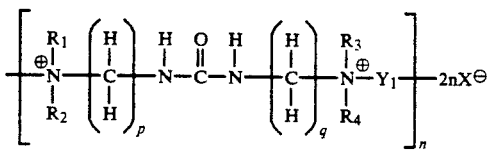

I wherein n is an integer of from 1 to about 200, $R_1$, $R_2$, $R_3$, and $R_4$ are each independently selected from the group consisting of alkyl groups, hydroxyalkyl groups, and polyoxyalkylene groups, p is an integer of from 1 to about 10, q is an integer of from 1 to about 10, X is an anion, and $Y_1$ is selected from the group consisting of $-CH_2CH_2OCH_2CH_2-$, $-CH_2CH_2OCH_2CH_2OCH_2CH_2-$, $-(CH_2)_k-$, wherein k is an integer of from about 2 to about 10, and $-CH_2CH(OH)CH_2-$; (b) polymers of Formula II

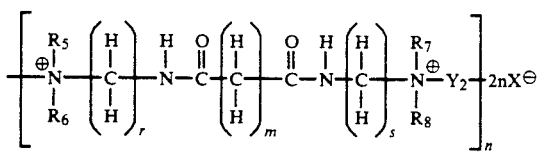

II wherein wherein n is an integer of from 1 to about 200, $R_5$, $R_6$, $R_7$, and $R_8$ are each independently selected from the group consisting of alkyl groups, hydroxyalkyl groups, and polyoxyalkylene groups, m is an integer of from 0 to about 40, r is an integer of from 1 to about 10, s is an integer of from 1 to about 10, X is an anion, and $Y_2$ is selected from the group consisting of $-CH_2CH_2OCH_2CH_2-$, $-CH_2CH_2OCH_2CH_2OCH_2CH_2-$, $-(CH_2)_k-$, wherein k is an integer of from about 2 to about 10, and $-CH_2CH(OH)CH_2-$; (c) copolymers of Formula III

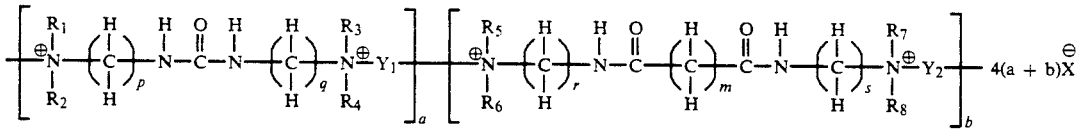

III wherein a and b are each integers wherein the sum of a+b is from about 2 to about 200, $R_1$, $R_2$, $R_3$, $R_4$, $R_5$, $R_6$, $R_7$, and $R_8$ are each independently selected from the group consisting of alkyl groups, hydroxyalkyl groups, and polyoxyalkylene groups, p is an integer of from 1 to about 10, q is an integer of from 1 to about 10, X is an anion, and $Y_1$ and $Y_2$ are each independently selected from the group consisting of $-CH_2CH_2OCH_2CH_2-$, $-CH_2CH_2OCH_2CH_2OCH_2CH_2-$, $-(CH_2)_k-$, wherein k is an integer of from about 2 to about 10, and $-CH_2CH(OH)CH_2-$; (d) mixtures of polymers of Formula I and polymers of Formula II; (e) mixtures of polymers of Formula I and copolymers of Formula III; (f) mixtures of polymers of Formula II and copolymers of Formula III; and (g) mixtures of polymers of Formula I, polymers of Formula II, and copolymers of Formula III; (2) an optional binder polymer; and (3) an optional filler.

DETAILED DESCRIPTION OF THE INVENTION

The recording sheets of the present invention comprise a substrate and a coating. Any suitable substrate can be employed. Examples include transparent materials, such as polyester, including Mylar TM, available from E.I. Du Pont de Nemours & Company, Melinex TM, available from Imperial Chemicals, Inc., Celanar TM, available from Celanese Corporation, polycarbonates such as Lexan TM, available from General Electric Company, polysulfones, cellulose triacetate, polyvinylchloride cellophane, polyvinyl fluoride, and the like, with polyester such as Mylar TM being preferred in view of its availability and relatively low cost. The substrate can also be opaque, such as paper, including plain papers such as Xerox ® 4024, diazo papers, or the like, or opaque plastics and filled polymers, such as Melinex ®, available from ICI. Filled plastics can also be employed as the substrate, particularly when it is desired to make a "never-tear paper" recording sheet.

In one embodiment of the present invention, the substrate comprises sized blends of hardwood kraft and softwood kraft fibers containing from about 10 to 90 percent by weight soft wood and from about 10 to about 90 percent by weight hardwood. Examples of hardwood include Seagull W dry bleached hardwood kraft, present in one embodiment in an amount of about 70 percent by weight. Examples of softwood include La Tuque dry bleached softwood kraft, present in one embodiment in an amount of about 30 percent by weight. These substrates can also contain fillers and pigments in any effective amounts, typically from about 1 to about 60 percent by weight, such as clay (available from Georgia Kaolin Company, Astro-fil 90 clay, Engelhard Ansilex clay), titanium dioxide (available from Tioxide Company - Anatase grade AHR), calcium silicate CH-427-97-8, XP-974 (J.M. Huber Corporation), and the like. The sized substrates can also contain sizing chemicals in any effective amount, typically from about 0.25 percent to about 25 percent by weight of pulp, such as acidic sizing, including Mon size (available from Monsanto Company), alkaline sizing such as Hercon-76 (available from Hercules Company), Alum (available from Allied Chemicals as Iron free alum), retention aid (available from Allied Colloids as Percol 292), and the like. The preferred internal sizing degree of papers selected for the present invention, including commercially available papers, varies from about 0.4 to about 5,000 seconds, and papers in the sizing range of from about 0.4 to about 300 seconds are more preferred, primarily to decrease costs. Preferably, the selected substrate is porous, and the porosity value of the selected substrate preferably varies from about 100 to about 1,260 milliliters per minute and preferably from about 50 to about 600 milliliters per minute to enhance the effectiveness of the recording sheet in various printing technologies, such as thermal transfer, liquid toner development, xerographic processes employing dry toner development, ink jet processes, and the like. Preferred basis weights for the substrate are from about 40 to about 400 grams per square meter, although the basis weight can be outside of this range.

Illustrative examples of lab samples of papers suitable for the present invention include the internally and non-surface sized prepared in Example I, the internally alkaline sized but without surface sizing papers prepared in Example II, the internally acid sized but without surface sizing papers prepared in Example III, and the internally and surface sized papers prepared in Example IV.

Illustrative examples of commercially available internally and externally (surface) sized substrates suitable for the present invention include Diazo papers, offset papers, such as Great Lakes offset, recycled papers, such as Conservatree, office papers, such as Automimeo, Eddy liquid toner paper and copy papers available from companies such as Nekoosa, Champion, Wiggins Teape, Kymmene, Modo, Domtar, Veitsiluoto and Sanyo, and the like, with Xerox ® 4024 TM papers and sized calcium silicateclay filled papers being particularly preferred in view of their availability, reliability, and low print through. Pigmented filled plastics, such as Teslin (available from PPG industries), are also preferred as supporting substrates.

The substrate can be of any effective thickness. Typical thicknesses for the substrate are from about 50 to about 500 microns, and preferably from about 100 to about 125 microns, although the thickness can be outside these ranges.

The recording sheets of the present invention contain on the substrate surface a coating containing a quaternary ammonium polymer selected from the group consisting of (a) polymers of Formula I

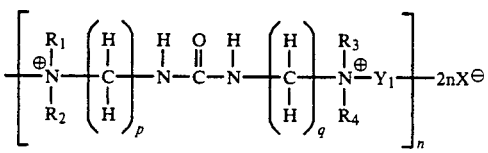

I wherein n is an integer of from 1 to about 200, $R_1$, $R_2$, $R_3$, and $R_4$ are each independently selected from the group consisting of alkyl groups, hydroxyalkyl groups, and polyoxyalkylene groups, wherein the number of carbon atoms is such that the material is water soluble, preferably being from about 1 to about 20, more preferably being from about 1 to about 10, and even more preferably being from about 1 to about 7, such as methyl, ethyl, propyl, butyl, pentyl, hexyl, benzyl, and the like, p is an integer of from 1 to about 10, q is an integer of from 1 to about 10, X is an anion, and $Y_1$ is selected from the group consisting of $-CH_2CH_2OCH_2CH_2-$, $-CH_2CH_2OCH_2CH_2OCH_2CH_2-$, $-(CH_2)_k-$, wherein k is 2, 3, 4, 5, 6, 7, 8, 9, or 10, and $-CH_2CH(OH)CH_2-$; (b) polymers of Formula II

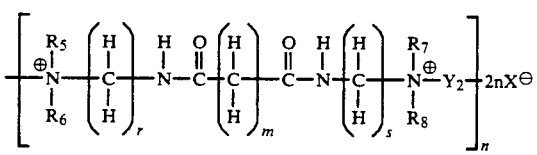

II wherein wherein n is an integer of from 1 to about 200, $R_5$, $R_6$, $R_7$, and $R_8$ are each independently selected from the group consisting of alkyl groups, hydroxyalkyl groups, and polyoxyalkylene groups, wherein the number of carbon atoms is such that the material is water soluble, preferably being from about 1 to about 20, more preferably being from about 1 to about 10, and even more preferably being from about 1 to about 7, such as methyl, ethyl, propyl, butyl, pentyl, hexyl, benzyl, and the like, m is an integer of from 0 to about 40, r is an integer of from 1 to about 10, s is an integer of from 1 to about 10, X is an anion, and $Y_2$ is selected from the group consisting of $-CH_2CH_2OCH_2CH_2-$, $-CH_2CH_2OCH_2CH_2OCH_2CH_2-$, $-(CH_2)_k-$, wherein k is 2, 3, 4, 5, 6, 7, 8, 9, or 10, and $-CH_2CH(OH)CH_2-$; (c) copolymers of Formula III

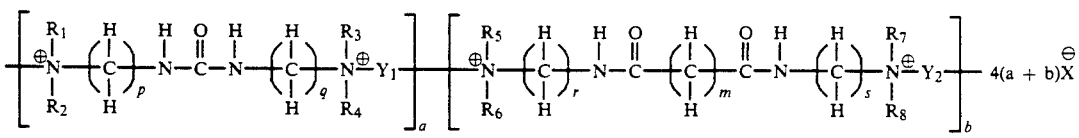

III wherein a and b are each integers wherein the sum of a+b is from about 2 to about 200, $R_1$, $R_2$, $R_3$, $R_4$, $R_5$, $R_6$, $R_7$, and $R_8$ are each independently selected from the group consisting of alkyl groups, hydroxyalkyl groups, and polyoxyalkylene groups, wherein the number of carbon atoms is such that the material is water soluble, preferably being from about 1 to about 20, more preferably being from about 1 to about 10, and even more preferably being from about 1 to about 7, such as methyl, ethyl, propyl, butyl, pentyl, hexyl, benzyl, and the like, p is an integer of from 1 to about 10, q is an integer of from 1 to about 10, X is an anion, and $Y_1$ and $Y_2$ are each independently selected from the group consisting of $-CH_2CH_2OCH_2CH_2-$, $-CH_2CH_2OCH_2CH_2OCH_2CH_2-$, $-(CH_2)_k-$, wherein k is 2, 3, 4, 5, 6, 7, 8, 9, or 10, and $-CH_2CH(OH)CH_2-$; (d) mixtures of polymers of Formula I and polymers of Formula II; (e) mixtures of polymers of Formula I and copolymers of Formula III; (f) mixtures of polymers of Formula II and copolymers of Formula III; and (g) mixture of polymers of Formula I, polymers of Formula II, and copolymers of Formula III. One example of a preferred quaternary ammonium polymer is one of Formula I wherein $R_1$, $R_2$, $R_3$, and $R_4$ are all methyl groups, p and q are each 3, n is 6, X is a chlorine anion, and Y is $-CH_2CH_2OCH_2CH_2-$. Compounds of this preferred formula are commercially available under the trade names Mirapol A-15 and Mirapol WT from Miranol, Incorporated, Dayton, N.J., and can be prepared as disclosed in U.S. Pat. No. 4,157,388, the disclosure of which is totally incorporated herein by reference. Another example of a preferred quaternary ammonium polymer is one of Formula II wherein $R_5$, $R_6$, $R_7$, and $R_8$ are all methyl groups, r and s are each 3, m is 7, n is 100, X is a chlorine anion, and Y is $-CH_2CH_2OCH_2CH_2-$. Compounds of this preferred formula are commercially available under the trade name Mirapol AZ-1 from Miranol, Incorporated, and can be prepared as disclosed in U.S. Pat. No. 4,719,382, the disclosure of which is totally incorporated herein by reference. Yet another example of a preferred quaternary ammonium polymer is one of Formula II wherein $R_5$, $R_6$, $R_7$, and $R_8$ are all methyl groups, r and s are each 3, m is 4, n is 100, X is a chlorine anion, and Y is $-CH_2CH_2OCH_2CH_2-$. Compounds of this preferred formula are commercially available under the trade name Mirapol AD-1 from Miranol, Incorporated, and can be prepared as disclosed in U.S. Pat. No. 4,157,388. Also suitable are block copolymers of Formula III containing two different blocks. The blocks can be present in any effective amount; typically, a first block is present in an amount of from about 5 to about 95 percent by weight and a second block is present in an amount of from about 5 to about 95 percent by weight, and preferably a first block is present in an amount of from about 30 to about 70 percent by weight and a second block is present in an amount of from about 30 to about 70 percent by weight, although the amounts can be outside of these ranges. Examples of such block copolymers include those commercially available from Miranol, Incorporated under the trade names of Mirapol 9, Mirapol 95, and Mirapol 175, which can be prepared as disclosed in U.S. Pat. No. 4,719,282. Also suitable are random copolymers of Formula III containing the monomeric units either in alternating or in random order. Blends of two or more of the polymers or copolymers of Formulae I, II, and III can also be employed.

The quaternary ammonium polymer is present in any effective amount. Typically, the quaternary ammonium polymer is present in an amount of from about 0.05 to about 20 percent by weight of the substrate, although the amount can be outside of this range.

The coatings employed for the recording sheets of the present invention can include an optional binder in addition to the quaternary ammonium polymer. Examples of suitable binder polymers include (a) hydrophilic polysaccharides and their modifications, such as (1) starch (such as starch SLS-280, available from St. Lawrence starch), (2) cationic starch (such as Cato-72, available from National Starch), (3) hydroxyalkylstarch, wherein alkyl has at least one carbon atom and wherein the number of carbon atoms is such that the material is water soluble, preferably from about 1 to about 20 carbon atoms, and more preferably from about 1 to about 10 carbon atoms, such as methyl, ethyl, propyl, butyl, or the like (such as hydroxypropyl starch (#02382, available from Poly Sciences Inc.) and hydroxyethyl starch (#06733, available from Poly Sciences Inc.)), (4) gelatin (such as Calfskin gelatin #00639, available from Poly Sciences Inc.), (5) alkyl celluloses and aryl celluloses, wherein alkyl has at least one carbon atom and wherein the number of carbon atoms is such that the material is water soluble, preferably from 1 to about 20 carbon atoms, more preferably from 1 to about 10 carbon atoms, and even more preferably from 1 to about 7 carbon atoms, such as methyl, ethyl, propyl, butyl, pentyl, hexyl, benzyl, and the like (such as methyl cellulose (Methocel AM 4, available from Dow Chemical Company)), and wherein aryl has at least 6 carbon atoms and wherein the number of carbon atoms is such that the material is water soluble, preferably from 6 to about 20 carbon atoms, more preferably from 6 to about 10 carbon atoms, and even more preferably about 6 carbon atoms, such as phenyl, (6) hydroxy alkyl celluloses, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as hydroxyethyl cellulose (Natrosol 250 LR, available from Hercules Chemical Company), and hydroxypropyl cellulose (Klucel Type E, available from Hercules Chemical Company)), (7) alkyl hydroxy alkyl celluloses, wherein each alkyl has at one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as ethyl hydroxyethyl cellulose (Bermocoll, available from Berol Kem. A. B. Sweden)), (8) hydroxy alkyl alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxyethyl methyl cellulose (HEM, available from British Celanese Ltd., also available as Tylose MH, MHK from Kalle A.G.), hydroxypropyl methyl cellulose (Methocel K35LV, available from Dow Chemical Company), and hydroxy butylmethyl cellulose (such as HBMC, available from Dow Chemical Company)), (9) dihydroxyalkyl cellulose, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dihydroxypropyl cellulose, which can be prepared by the reaction of 3-chloro-1,2-propane with alkali cellulose), (10) hydroxy alkyl hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxypropyl hydroxyethyl cellulose, available from Aqualon Company), (11) halodeoxycellulose, wherein halo represents a halogen atom (such as chlorodeoxycellulose, which can be prepared by the reaction of cellulose with sulfuryl chloride in pyridine at 25° C.), (12) amino deoxycellulose (which can be prepared by the reaction of chlorodeoxy cellulose with 19 percent alcoholic solution of ammonia for 6 hours at 160° C.), (13) dialkylammonium halide hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as diethylammonium chloride hydroxy ethyl cellulose, available as Celquat H-100, L-200, National Starch and Chemical Company), (14) hydroxyalkyl trialkyl ammonium halide hydroxyalkyl cellulose, wherein each alkyl least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as hydroxypropyl trimethyl ammonium chloride hydroxyethyl cellulose, available from Union Carbide Company as Polymer JR), (15) dialkyl amino alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, (such as diethyl amino ethyl cellulose, available from Poly Sciences Inc. as DEAE cellulose #05178), (16) carboxyalkyl dextrans, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, and the like, (such as carboxymethyl dextrans, available from Poly Sciences Inc. as #16058), (17) dialkyl aminoalkyl dextran, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as diethyl aminoethyl dextran, available from Poly Sciences Inc. as #5178), (18) amino dextran (available from Molecular Probes Inc), (19) carboxy alkyl cellulose salts, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethyl cellulose CMC 7HOF, available from Hercules Chemical Company), (20) gum arabic (such as #G9752, available from Sigma Chemical Company), (21) carrageenan (such as #C1013 available from Sigma Chemical Company), (22) Karaya gum (such as #G0503, available from Sigma Chemical Company), (23) xanthan (such as Keltrol-T, available from Kelco division of Merck and Company), (24) chitosan (such as #C3646, available from Sigma Chemical Company), (25) carboxyalkyl hydroxyalkyl guar, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as carboxymethyl hydroxypropyl guar, available from Auqualon Company), (26) cationic guar (such as Celanese Jaguars C-14-S, C-15, C-17, available from Celanese Chemical Company), (27) n-carboxyalkyl chitin, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as n-carboxymethyl chitin, (28) dialkyl ammonium hydrolyzed collagen protein, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dimethyl ammonium hydrolyzed collagen protein, available from Croda as Croquats), (29) agaragar (such as that available from Pfaltz and Bauer Inc), (30) cellulose sulfate salts, wherein the cation is any conventional cation, such as sodium, lithium, potassium, calcium, magnesium, or the like (such as sodium cellulose sulfate #023 available from Scientific Polymer Products), and (31) carboxyalkylhydroxyalkyl cellulose salts, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethylhydroxyethyl cellulose CMHEC 43H and 37L available from Hercules Chemical Company); (b) vinyl polymers, such as (1) poly(vinyl alcohol) (such as Elvanol available from Dupont Chemical Company), (2) poly (vinyl phosphate) (such as #4391 available from Poly Sciences Inc.), (3) poly (vinyl pyrrolidone) (such as that available from GAF Corporation), (4) vinyl pyrrolidone-vinyl acetate copolymers (such as #02587, available from Poly Sciences Inc.), (5) vinyl pyrrolidone-styrene copolymers (such as #371, available from Scientific Polymer Products), (6) poly (vinylamine) (such as #1562, available from Poly Sciences Inc.), (7) poly (vinyl alcohol) alkoxylated, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly (vinyl alcohol) ethoxylated #6573, available from Poly Sciences Inc.), and (8) poly (vinyl pyrrolidone-dialkylaminoalkyl alkylacrylate), wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly (vinyl pyrrolidone-diethylaminomethylmethacrylate) #16294 and #16295, available from Poly Sciences Inc.); (c) formaldehyde resins, such as (1) melamine-formaldehyde resin (such as BC 309 , available from British Industrial Plastics Limited), (2) urea-formaldehyde resin (such as BC777, available from British Industrial Plastics Limited), and (3) alkylated urea-formaldehyde resins, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methylated urea-formaldehyde resins, available from American Cyanamid Company as Beetle 65); (d) ionic polymers, such as (1) poly(2-acrylamide-2-methyl propane sulfonic acid) (such as #175 available from Scientific Polymer Products), (2) poly (N,N-dimethyl-3,5-dimethylene piperidinium chloride) (such as #401, available from Scientific Polymer Products), and (3) poly(methylene-guanidine)hydrochloride (such as #654, available from Scientific Polymer Products); (e) latex polymers, such as (1) cationic, anionic, and nonionic styrene-butadiene latexes (such as that available from Gen Corp Polymer Products, such as RES 4040 and RES 4100, available from Unocal Chemicals, and such as DL 6672A, DL6638A, and DL6663A, available from Dow Chemical Company), (2) ethylenevinylacetate latex (such as Airflex 400, available from Air Products and Chemicals Inc.), and (3) vinyl acetate-acrylic copolymer latexes (such as synthemul 97-726, available from Reichhold Chemical Inc, Resyn 25-1110 and Resyn 25-1140, available from National Starch Company, and RES 3103 available from Unocal Chemicals; (f) maleic anhydride and maleic acid containing polymers, such as (1) styrene-maleic anhydride copolymers (such as that available as Scripset from Monsanto, and the SMA series available from Arco), (2) vinyl alkyl ether-maleic anhydride copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinyl methyl ether-maleic anhydride copolymer #173, available from Scientific Polymer Products), (3) alkylene-maleic anhydride copolymers, wherein alkylene has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as ethylene-maleic anhydride copolymer #2308, available from Poly Sciences Inc., also available as EMA from Monsanto Chemical Company), (4) butadiene-maleic acid copolymers (such as #07787, available from Poly Sciences Inc.), (5) vinylalkylether-maleic acid copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinylmethylether-maleic acid copolymer, available from GAF Corporationas Gantrez S-95), and (6) alkyl vinyl ether-maleic acid esters, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methyl vinyl ether-maleic acid ester #773, available from Scientific Pokymer Products); (g) acrylamide containing polymers, such as (1) poly (acrylamide) (such as #02806, available from Poly Sciences Inc.), (2) acrylamide-acrylic acid copolymers (such as #04652, #02220, and #18545, available from Poly Sciences Inc.), and (3) poly (N,N-dimethyl acrylamide) (such as #004590, available from Poly Sciences Inc.); and (h) poly (alkylene imine) containing polymers, wherein alkylene has two (ethylene), three (propylene), or four (butylene) carbon atoms, such as (1) poly(ethylene imine) (such as #135, available from Scientific Polymer Products), (2) poly(ethylene imine) epichlorohydrin (such as #634, available from Scientific Polymer Products), and (3) alkoxylated poly (ethylene imine), wherein alkyl has one (methoxylated), two (ethoxylated), three (propoxylated), or four (butoxylated) carbon atoms (such as ethoxylated poly (ethylene imine #636, available from Scientific Polymer Products); and the like, as well as blends or mixtures of any of the above, with starches and latexes being particularly preferred because of their availability and applicability to paper. Any mixtures of the above ingredients in any relative amounts can be employed.

If present, the binder can be present within the coating in any effective amount; typically the binder and the quaternary ammonium polymer are present in relative amounts of from about 0.5 parts by weight binder and about 1 part by weight quaternary ammonium polymer to about 5 parts by weight binder and about 1 part by weight quaternary ammonium polymer, although the relative amounts can be outside of this range.

In addition, the coating of the recording sheets of the present invention can contain optional filler components. Fillers can be present in any effective amount, and if present, typically are present in amounts of from about 1 to about 60 percent by weight of the coating composition. Examples of filler components include colloidal silicas, such as Syloid 74, available from Grace Company (preferably present, in one embodiment, in an amount of about 20 weight percent), titanium dioxide (available as Rutile or Anatase from NL Chem Canada, Inc.), hydrated alumina (Hydrad TMC-HBF, Hydrad TM-HBC, available from J. M. Huber Corporation), barium sulfate (K. C. Blanc Fix HD80, available from Kali Chemie Corporation), calcium carbonate (Microwhite Sylacauga Calcium Products), high brightness clays (such as Engelhard Paper Clays), calcium silicate (available from J. M. Huber Corporation), cellulosic materials insoluble in water or any organic solvents (such as those available from Scientific Polymer Products), blend of calcium fluoride and silica, such as Opalex-C available from Kemira.O.Y, zinc oxide, such as Zoco Fax 183, available from Zo Chem, blends of zinc sulfide with barium sulfate, such as Lithopane, available from Schteben Company, and the like, as well as mixtures thereof. Brightener fillers can enhance color mixing and assist in improving print-through in recording sheets of the present invention.

The quaternary ammonium copolymer containing coating is present on the substrate of the recording sheet of the present invention in any effective thickness. Typically, the total thickness of the coating layer is from about 0.1 to about 25 microns and preferably from about 0.5 to 10 microns, although the thickness can be outside of these ranges.

The coating containing the quaternary ammonium polymer can be applied to the substrate by any suitable technique, such as size press treatment, dip coating, reverse roll coating, extrusion coating, or the like. For example, the coating can be applied with a KRK size press (Kumagai Riki Kogyo Co., Ltd., Nerima, Tokyo, Japan) by dip coating and can be applied by solvent extrusion on a faustel Coater. The KRK size press is a lab size press that simulates a commercial size press. This size press is normally sheet fed, whereas a commercial size press typically employs a continuous web. On the KRK size press, the substrate sheet is taped by one end to the carrier mechanism plate. The speed of the test and the roll pressures are set, and the coating solution is poured into the solution tank. A 4 liter stainless steel beaker is situated underneath for retaining the solution overflow. The coating solution is cycled once through the system (without moving the substrate sheet) to wet the surface of the rolls and then returned to the feed tank, where it is cycled a second time. While the rolls are being "wetted", the sheet is fed through the sizing rolls by pressing the carrier mechanism start button. The coated sheet is then removed from the carrier mechanism plate and is placed on a 12 inch by 40 inch sheet of 750 micron thick Teflon for support and is dried on the Dynamic Former drying drum and held under restraint to prevent shrinkage. The drying temperature is approximately 105° C. This method of coating treats both sides of the substrate simultaneously.

In dip coating, a web of the material to be coated is transported below the surface of the liquid coating composition by a single roll in such a manner that the exposed site is saturated, followed by removal of any excess coating by the squeeze rolls and drying at 100° C. in an air dryer. The liquid coating composition generally comprises the desired coating composition dissolved in a solvent such as water, methanol, or the like. The method of surface treating the substrate using a coater results in a continuous sheet of substrate with the coating material applied first to one side and then to the second side of this substrate. The substrate can also be coated by a slot extrusion process, wherein a flat die is situated with the die lips in close proximity to the web of substrate to be coated, resulting in a continuous film of the coating solution evenly distributed across one surface of the sheet, followed by drying in an air dryer at 100° C.

In one embodiment, the recording sheets of the present invention are papers prepared by providing porous acid sized substrates with (a) 0.4 second internal sizing, but no surface sizing, in a thickness of 112 microns and a porosity of 220 milliliters per minute, and (b) diazo papers with a sizing degree (sum of internal sizing degree plus surface sizing degree) of 1100 seconds, a porosity of 375 milliliters per minute, and a thickness of 90 microns, and applying to both sides of each paper on a size press, in a thickness of 0.5 microns on each side, quaternary ammonium polymers such as Mirapol A-15, Mirapol AD-1, or Mirapol 175, which are precent in a concentration of 2 percent by weight in water. Thereafter, the papers are air dried at 100° C., and the resulting papers are fed manually into a Xerox® 4020 Color ink jet printer to obtain images of high optical density which are resistant to humidity and are water-fast.

In another embodiment, the recording sheets of the present invention are prepared by providing (a) commercially available acid sized diazo papers in roll form, such as those available from Domtar, Inc., Canada, (b) porous, 125 micron thick, with a porosity of 600 milliliters per minute, alkaline sized (2 seconds internal sizing degree), calcium carbonate filled substrated, (c) porous alkaline internally sized substrates filled with calcium silicate and titanium dioxide, with an internal sizing degree of 4685 seconds, a porosity of 375 milliliters per minute, and a thickness of 130 seconds, a porosity of 375 milliliters per minute, and a thickness of 130 microns, surface sizing on a size press each substrate with a blend containing 66 percent by weight cationic starch and 34 percent by weight quaternary ammonium polymer such as Mirapol AD-1, which blend is present in a concentration of 5 percent by weight in water. Thereafter the sheets are air dried at 105° C., and the resulting recording sheets can be utilized in a Xerox® 4020 color ink jet printer as well as in a Xerox® 1005 color copier.

In another specific process embodiment, the papers of the present invention are prepared by providing a substrate such as acid sized diazo papers (sizing value (sum of internal sizing degree plus surface sizing degree) 1100 seconds) or Xerox® 4024 (internally acid sized but without any surface sizing) (obtained in roll form) with a thickness of about 108 microns with an internal sizing degree of 68 seconds, a porosity of 915 milliliters per minute, and applying to the substrate by extrusion coating on a Faustel Coater, to one side a ternary blend of a quaternary ammonium block copolymer such as Mirapol 175, precent in an amount of about 5 percent by weight, a styrene-butadiene latex, such as Dow 638A, precent in an amount of about 20 precent by weight, and calcium carbonate, such as Microwhite, present in an amount of about 75 percent by weight, which blend is present in a concentration of 30 percent by weight in water. Thereafter the coating is air dried at 100° C. and the coated substrates can be used in a Xerox® 4020 color ink jet printer to obtain fast drying (less than 10 seconds) images with high optical density (greater than one in some embodiments) and resistance to humidity (greater than 90 percent water fast in some embodiments). These papers can also be used in a Xerox® 1038 copier to obtain images with optical density values of 1.3 black. These images cannot be hand wiped or lifted off with a 3M Scotch tape 60 seconds subsequent to their preparation. Other recording sheets of the present invention can be prepared in a similiar or equivalent manner.

The drying time of images obtained with the treated papers of the present application is the time for zero image-offset and can be measured as follows: a line comprising different color sequences is drawn on the paper with droplets of inks from an ink jet printhead moving from left to right and back. Thereafter, this image is purposely smeared with the pinch roll of the printer by fast forwarding the paper mechanically while the pinch roll is on the top of the imaged line. This entire procedure takes about two seconds to complete. In the event that no offset of the printed image on the unprinted paper occurs, the drying time of the image is considered as less than two seconds.

The Hercules size values recited herein were measured on the Hercules sizing tester (available from Hercules Incorporated) as described in TAPPI STANDARD T-530 pm-83, issued by the Technical Association of the Pulp and Paper Industry. This method is closely related to the widely used ink flotation test. The TAPPI method has the advantage over the ink flotation test of detecting the end point photometrically. The TAPPI method employs a mildly acidic aqueous dye solution as the penetrating component to permit optical detection of the liquid front as it moves through the paper sheet. The apparatus determines the time required for the reflectance of the sheet surface not in contact with the penetrant to drop to a predetermined (80 percent) percentage of its original reflectance.

The porosity values recited herein were measured with a Parker Print-Surf porosimeter, which records the volume of air per minute flowing through a sheet of paper.

The optical density measurements and the print through values recited herein were obtained on a Pacific Spectrograph Color System. The system consists of two major components, an optical sensor and a data terminal. The optical sensor employs a 6 inch integrating sphere to provide diffuse illumination and 2 degrees viewing. This sensor can be used to measure both transmission and reflectance samples. When reflectance samples are measured, a specular component may be included. A high resolution, full dispersion, grating monochromator was used to scan the spectrum from 380 to 720 nanometers (nm). The data terminal features a 12 inch CRT display, numerical keyboard for selection of operating parameters, and the entry of tristimulus values, and an alphanumeric keyboard for entry of product standard information. The print through value as characterized by the printing industry is Log base 10 (reflectance of a single sheet of unprinted paper against a black background/reflectance of the back side of a black printed area against a black background) measured at a wavelength of 560 nanometers.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Twenty 8.5 by 11.0 inch sheets, 112 microns thick, of plain paper with a Hercules internal sizing degree of 0.4 second and a porosity of 220 milliliters per minute were prepared on a Dynamic Former lab paper machine (manufactured by Allimand France) using a filtered fiber pad weighing 400 grams comprising 70 percent by weight Seagull W dry bleached hardwood kraft and 30 percent by weight La Tuque dry bleached softwood kraft beaten in the valley beater for 27 minutes. Pulp material was added to a stainless steel storage tank and the percent solids was adjusted to 0.4 percent oven dry with deionized water. The pH of the mixture was adjusted to 5.3 by the addition of alum. During the paper making process, the following operating conditions were used: wire speed —935 meters/minute, jet speed—935 meters/minute, jet to wire ratio—1.0, stock flow—1.5 liters/minute, stock pressure—2.7 bars, number of passes—105, sheet basis weight—75.0 grams/square meter, forming wire screen type—77×56 mesh plastic wire screen from Johnson Wire Company, nozzle type-Model 2504-SS, and nozzle settings-angle centered-spacing 6.0 centimeters.

The Dynamic Former was loaded with the selected forming wire screen and the main drive motor was turned on. When the forming wire reached its required speed, water was added to the Former drum to allow the water wall to become level with the retaining bars. The 400 gram pulp load (furnish) was then pumped from the holding tank to the spray nozzle, and the spray nozzle drive was started to spray the furnish evenly on the rotating wire screen. When sufficient furnish had been sprayed to form a sheet of paper, the nozzle drive motor and the pump motor were deactivated while the main drive continued to run. The excess water was then slowly removed by movement of a scoop, which caused the waterwall to drain, leaving a thin pad of pulp fiber furnish evenly distributed on the plastic wire screen. The main drive motor was then deactivated and the endless belt of fiber was carefully cut and lifted out of the Former drum while the belt was still on the plastic wire screen. The wet paper sheet (at approximately 20 percent solid) was then placed on a wool felt blanket and the plastic wire screen was removed. A sheet of 750 microns thick Teflon was placed on top of the wet paper sheet and the sandwich pad was then pressed through the Dynamic Former press section to increase the solid content to 45 percent level. This was accomplished by passing the sandwich pad between the press rolls once at a nip pressure of 4.0 bar and twice at a nip pressure of 6.0 bar. The sheet of paper along with the Teflon backing sheet was lifted off the felt wool blanket and placed on the drying drum with Teflon in contact with the dryer surface. The dryer felt was then lowered over the paper sheet and was clamped in position to restrain the sheet and prevent shrinkage during the drying process at 105° C.

Ten of these laboratory paper sheets with 0.4 second internal sizing, but no surface sizing, were fed individually into a Xerox ® 4020 color ink jet printer employing four separate inks comprising 92 percent by weight water, 5 percent by weight ethylene glycol, and 3 percent by weight of a magenta, cyan, yellow, or black colorant. The images thus obtained exhibited average optical densities of 1.10 (black), 1.12 (magenta), 0.99 (cyan), and 0.85 (yellow) before washing and 1.04 (black), 0.79 (magenta), 0.65 (cyan), and 0.76 (yellow) after washing under a running hot (50° C.) water tap for two minutes and air drying the images.

The ten remaining sheets were treated on a KRK size press (Kumagai Riki Kogyo Co., Ltd., Nerima, Tokyo, Japan) (both sides treated) with a 2 percent by weight aqueous solution of quaternary ammonium polymer (Mirapol 175, obtained from Miranol Incorporated). Subsequent to drying at 105° C. and monitoring the difference in weight prior to and subsequent to size press treatment, the paper sheets were found to be coated on each side with 50 milligrams, 0.5 micron in thickness (each side), of Mirapol 175. These sheets were then fed into the Xerox ® 4020 color ink jet printer and the images thus obtained exhibited an average optical density values of 1.10 (black), 1.32 (magenta), 1.03 (cyan), and 1.00 (yellow) before and 1.15 (black), 1.22 (magenta), 1.03 (cyan), and 1.04 (yellow) after washing with hot (~50° C.) water for two minutes. This Example demonstrates the dye fixing capability of recording sheets of the present invention having a coating comprising a quaternary ammonium copolymer such as Mirapol 175.

EXAMPLE II

Twenty sheets (8.5 by 11 inches) of calcium carbonate filled (filler present in an amount of 15 percent by weight of the paper pulp) internally ASA (alkaline) sized (sizing degree of 2 seconds) porous (porosity 700 milliliters per minute) papers were prepared on a Dynamic Former paper machine in a thickness of 105 microns, having no surface sizing, by the process described in Example I. Ten of these sheets were fed into a Xerox ® 4020 color ink jet printer, and the images obtained exhibited average optical densities of 1.09 (black), 0.98 (magenta), 0.92 (cyan), and 0.73 (yellow) before washing and 1.01 (black), 0.78 (magenta), 0.86 (cyan), and 0.63 (yellow) after washing under a running hot (50° C.) water tap for two minutes and air drying the images.

Of the ten remaining sheets, five were treated on a KRK size press (both sides treated) by the process described in Example I with a 2 percent by weight aqueous solution of quaternary ammonium polymer Mirapol AD-1 and five were treated on a KRK size press (both sides treated) by the process described in Example I with a 2 percent by weight aqueous solution of quaternary ammonium polymer Mirapol A-15, both polymers being available from Miranol Incorporated. Subsequent to drying at 105° C. and monitoring the weight prior to and subsequent to size press treatment, the paper sheets were coated on each side with 45 milligrams in a thickness of 0.45 microns (each side) of the quaternary ammonium polymers. These sheets were fed into the Xerox ® 4020 color ink jet printer the images thus obtained exhibited optical density values for Mirapol A-15 and Mirapol AD-1, respectively, of 1.20, 1.17 (black), 1.08, 1.06 (magenta), 0.95, 0.92 (cyan), and 0.80, 0.78 (yellow), before washing and 1.24, 1.24 (black), 1.08, 1.06 (magenta), 0.96, 0.96 (cyan), and 0.80, 0.81 (yellow) after washing with hot (~50° C.) water for two minutes. This Example demonstrates the dye fixing capability of quaternary ammonium polymers such as Mirapol AD-1 and Mirapol A-15.

EXAMPLE III

Ten sheets of Xerox ® 4024 (no surface sizing) paper with an internal acidic sizing degree of 68 seconds, a porosity of 915 milliliters per minute, and thickness of 108 microns were printed with the Xerox ® 4020 color ink jet printer, and the images thus obtained exhibited average optical densities of 1.08 (black), 1.09 (magenta), 0.98 (cyan), and 0.85 (yellow) before washing and 0.97 (black), 0.45 (magenta), 0.55 (cyan), and 0.71 (yellow) after washing under a running hot (50° C.) water tap for two minutes and air drying the images.

Of ten additional Xerox ® 4024 paper sheets (no surface sizing), three were treated on a KRK size press (both sides treated) by the process described in Example I with a 2 percent by weight aqueous solution of quaternary ammonium polymer Mirapol A-15, three were treated on a KRK size press (both sides treated) by the process described in Example I with a 2 percent by weight aqueous solution of quaternary ammonium block copolymer Mirapol 9, and four were treated on a KRK size press (both sides treated) by the process described in Example I with a 2 percent by weight aqueous solution of quaternary ammonium polymer Mirapol AD-1. Subsequent to drying at 105° C. and monitoring the weight prior to and subsequent to size press treatment, the paper sheets were coated on each side with 55 milligrams in a thickness of 0.55 microns (each side) of the quaternary ammonium polymers. These sheets were fed into the Xerox ® 4020 color ink printer and the images thus obtained exhibited optical density values for Mirapol A-15, Mirapol 9, and Mirapol AD-1, respectively, of 1.10, 1.10, 1.12 (black), 1.17, 1.20, 1.20 (magenta), 1.09, 1.09, 1.10 (cyan), and 0.95, 0.95, 0.96 (yellow) before washing and 1.09, 1.08, 1.07 (black), 1.11, 1.06, 1.02 (magenta), 1.09, 1.07, 1.05 (cyan), and 0.98, 0.98, 0.96 (yellow) after washing with hot water (~50° C.) for two minutes. This Example demonstrates that coating compositions containing a quaternary ammonium polymer such as Mirapol A-15, which are of a chemical structure of Formula I wherein $R_1$, $R_2$, $R_3$, and $R_4$ are all methyl groups, p and q are each 3, n is 6, X is a chlorine anion, and Y is $—CH_2CH_2OCH_2CH_2—$, are slightly better than coating compositions containing a quaternary ammonium polymer such as Mirapol AD-1, which are of a chemical structure of Formula II wherein $R_5$, $R_6$, $R_7$, and $R_8$ are all methyl groups, r and s are each 3, m is 4, n is 100, X is a chlorine anion, and Y is $—CH_2CH_2OCH_2CH_2—$, and quaternary ammonium block copolymers such as Mirapol 9, which are block copolymers of a chemical structure of Formula III wherein within the first block $R_1$, $R_2$, $R_3$, and $R_4$ are all methyl groups, p and q are each 3, a is 6, X is a chlorine anion, and $Y_1$ is $—CH_2CH_2OCH_2CH_2—$ and wherein within the second block $R_5$, $R_6$, $R_7$, and $R_8$ are all methyl groups, r and s are each 3, m is 4, b is 100, X is a chlorine anion, and $Y_2$ is $—CH_2CH_2OCH_2CH_2—$, fall in the middle of the other two structures for purposes of fixing dyes of inks used in the 4020 color ink jet printer on 4024 base paper having no surface sizing.

EXAMPLE IV

Ten internally and surface sized diazo papers obtained from Domtar Paper Co., Canada, 90 micron thick and with a Hercules sizing degree (sum of internal and surface sizing) of 1100 seconds were fed into a Xerox ® 4020 color ink jet printer and the images thus obtained exhibited average optical density values of 0.81 (black), 0.90 (magenta), 0.76 (cyan), and 0.81 (yellow) before washing and 0.75 (black), 0.34 (magenta), 0.28 (cyan), and 0.79 (yellow) after washing with hot (~50° C.) water for two minutes. Of ten additional sheets of these diazo papers, two were treated by a dip coating process with a 2 percent aqueous solution of Mirapol A-15, three were treated by a dip coating process with a 2 percent aqueous solution of Mirapol 175, two were treated by a dip coating process with a 2 percent aqueous solution of Mirapol AD-1, and three were treated by a dip coating process with a 2 percent aqueous solution of Nalcolyte 7607 (sold as Nalpoly 607 in Japan by the Nalco Chemical Company of U.S.A. and disclosed in U.S. Pat. No. 4,576,867, the disclosure of which is totally incorporated herein by reference). Subsequent to drying at 105° C. and monitoring the weight prior to and subsequent to size press treatment, the paper sheets were coated on each side with 55 milligrams in a thickness of 0.55 microns (each side) of the quaternary ammonium polymers. These sheets were then fed into the Xerox ® 4020 color ink jet printer and the images thus obtained exhibited optical density values for Mirapol A-15, Mirapol 175, Mirapol AD-1, and Nalcolyte 7607, respectively, of 0.84, 0.79, 0.82, 0.72 (black), 0.85, 0.83, 0.84, 0.79 (magenta), 0.84, 0.72, 0.78, 0.64 (cyan), and 0.78, 0.77, 0.75, 0.67 (yellow) before washing and 1.04, 1.04, 0.99, 0.80 (black), 0.86, 0.85, 0.86, 0.89 (magenta), 0.75, 0.72, 0.78, 0.42 (cyan), and 0.89, 0.89, 0.88, 0.78 (yellow) after washing with water at about 50° C. for two minutes and air drying the images. This Example demostrates that diazo paper sheets treated with Mirapol products which contain structures of the present invention have higher initial optical densities, such as 10 to 16 percent in black, 6 to 7.5 percent in magenta, 12 to 30 percent in cyan, and 12 to 16 percent in yellow, than those treated with Nalcolyte 7607, the product cited in U.S. Pat. No. 4,576,867 (Kamagaya). In addition, the Mirapol product treated diazo sheets exhibited a higher percentage (80 percent) of cyan fixed on the paper than the Nalcolyte 7607 treated diazo papers (65 percent).

EXAMPLE V 60 sheets of the diazo paper described in Example IV were treated on a KRK size press by the process described in Example I with quaternary ammonium polymer/binder blends as follows: (a) 20 sheets were treated with a blend of 35 percent by weight Mirapol 175 and 65 percent by weight cationic starch (available as Cato-72 from National Starch); (b) 20 sheets were treated with a blend of 35 percent by weight Mirapol 175 and 65 percent by weight of poly (vinyl alcohol) ethoxylated (available from Poly Sciences Incorporated); (c) 20 sheets were treated with a blend of 35 percent by weight Mirapol 175 and 65 percent by weight methylated urea-formaldehyde (available as Beetle 65 from American Cyanamid Company). All of these blends were present in concentrations of 5 percent by weight in water. Subsequent to drying at 105° C. and monitoring the weight prior to subsequent to size press treatment, these sheets were coated on each side with 200 milligrams in thickness (each side) of 2 microns of the blends containing quaternary ammonium polymers. Ten sheets of each type were then fed into a Xerox ® 4020 color ink jet printer. The images thus obtained dried in less than ten seconds and exhibited optical density values for the binders of cationic starch, poly(vinyl alcohol) ethoxylated, and methylated urea-formaldehyde resin, respectively, of 1.21, 1.24, 0.82 (black), 1.14, 1.24, 0.85 (magenta), 1.03, 1.02, 0.77 (cyan), and 0.85, 0.94, 0.80 (yellow) before washing and 1.22, 1.30, 1.13 (black), 1.14, 1.22, 1.02 (magenta), 1.00, 0.95, 0.74 (cyan), and 0.85, 0.95, 0.95 (yellow) after washing with hot (~50° C.) water for two minutes. This Example demonstrates that the quaternary ammonium polymers of the present invention can be applied to paper in combination with various binders without losing their dye fixing properties.

The remaining ten treated sheets coated with each binder were then fed into a Xerox ® 1005 color xerographic imaging apparatus. The average optical densities of the thirty images thus obtained were 1.6 (black), 1.40 (magenta), 1.55 (cyan) and 0.80 (yellow). These images could not be handwiped or lifted off with 3M Scotch tape 60 seconds subsequent to their preparation.

This Example demonstrates that although the optical density values in the ink jet printing were dependent on the binder used in combination with the quaternary ammonium polymer, the optical density values of the xerographic images were identical regardless of the binder used within the experimental error of ±0.03.

EXAMPLE VI

Twenty coated papers were prepared by the solvent extrusion process (single side each time) on a Faustel coater by providing a substrate sheet of Xerox ® 4024 paper (internally acid sized but without any surface sizing) obtained (in roll form) in a thickness of 108 microns, with internal sizing of 68 seconds and a porosity of 915 milliliters per minute. The sheets were coated with a ternary blend comprising a quaternary ammonium block copolymer (Mirapol 175) in an amount of 5 percent by weight, a styrene-butadiene latex (Dow 638A) in an amount of 20 percent by weight, and calcium carbonate (Microwhite, available from Sylacauga Calcium Products) in an amount of 75 percent by weight, which blend was present in a concentration of 30 percent by weight in water. Subsequent to drying at 100° C. and monitoring the weight prior to and subsequent to coating, these sheets were coated with 300 milligrams in a thickness of 3 microns of the blend containing quaternary ammonium polymer. These sheets were then fed into a Xerox ® 4020 color ink jet printer and the images thus obtained exhibited average optical density values of 1.47 (black), 1.24 (magenta), 1.24 (cyan), and 0.87 (yellow) before washing and 1.50 (black), 1.18 (magenta), 1.20 (cyan), and 0.88 (yellow) after washing with hot (~50° C.) water for two minutes.

EXAMPLE VII

Ten coated papers were prepared by a dip coating process (both sides coated) by providing an acid sized diazo paper obtained from Domtar Paper Co., Canada, with a sizing degree (sum of internal plus surface sizing) of 1100 seconds, a porosity of 375 milliliters per minute, and a thickness of 90 microns, and dip coating the paper with a coating composition comprising a ternary blend of a quaternary ammonium block copolymer (Mirapol A-15) in an amount of 5 percent by weight, a styrene-butadiene latex (Dow 638A) in an amount of 38 percent by weight, and calcium carbonate (Microwhite, available from Sylacauga calcium products) in an amount of 57 percent by weight, which blend was present in a concentration of 25 percent by weight in water. Subsequent to drying at 25° C. and monitoring the weight prior to and subsequent to dip coating, these sheets were coated with 1500 milligrams of the blend (on each side) in a thickness of 15 microns (each side). These sheets were then fed into a Xerox ® 1038 xerographic imaging apparatus. The images thus obtained exhibited an average optical density value of 1.35 (black). These images could not be handwiped or lifted off with 3M Scotch tape 60 seconds subsequent to their preparation.

EXAMPLE VIII

Ten plastic papers (Teslin, available from P.P.G. Industries) with a thickness of 175 microns were fed individually into a Xerox ® 4020 color ink jet printer. The images thus obtained exhibited optical density values of 0.95 (black), 0.64 (magenta), 1.13 (cyan), and 0.67 (yellow) before washing and 0.96 (black), 0.36 (magenta), 0.81 (cyan), and 0.47 (yellow) after washing with water at about 50° C. for 2 minutes. Ten additional Teslin papers were coated via a dip coating process (both sides coated) with an aqueous 3 percent solution of Mirapol AD-1. Subsequent to drying at 25° C. and monitoring the weight prior to and subsequent to dip coating, these sheets were coated with 300 milligrams each side in a thickness of 2.5 microns (each side) of Mirapol AD-1. These sheets were then fed into a Xerox® 4020 color ink jet printer. The images thus obtained exhibited optical density values of 0.98 (black), 0.76 (magenta), 0.96 (cyan), and 0.71 (yellow) before and after washing with water at 50° C. for two minutes. This Example demonstrates that Mirapol AD-1 having a structure of the present invention can fix dyes used in 4020 inks onto Teslin "never-tear" papers.

Other embodiments and modifications of the present invention may occur to those skilled in the art subsequent to a review of the information presented herein; these embodiments and modifications, as well as equivalents thereof, are also included within the scope of this invention.

What is claimed is:

1. A recording sheet which comprises a substrate and a coating consisting essentially of (1) quaternary ammonium polymers selected from the group consisting of (a) polymers of Formula I

I

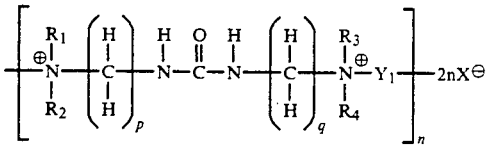

wherein n is an integer of from 1 to about 200, $R_1$, $R_2$, $R_3$, and $R_4$ are each independently selected from the group consisting of alkyl groups, hydroxyalkyl groups, and polyoxyalkylene groups, p is an integer of from 1 to about 10, q is an integer of from 1 to about 10, X is an anion, and $Y_1$ is selected from the group consisting of $-CH_2CH_2OCH_2CH_2-$, $-CH_2CH_2OCH_2CH_2OCH_2CH_2-$, $-(CH_2)_k-$, wherein k is an integer of from about 2 to about 10, and $-CH_2CH(OH)CH_2-$; (b) polymers of Formula II

II

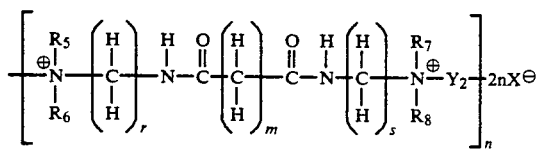

wherein wherein n is an integer of from 1 to about 200, $R_5$, $R_6$, $R_7$, and $R_8$ are each independently selected from the group consisting of alkyl groups, hydroxyalkyl groups, and polyoxyalkylene groups, m is an integer of from 0 to about 40, r is an integer of from 1 to about 10, s is an integer of from 1 to about 10, X is an anion, and $Y_2$ is selected from the group consisting of $-CH_2CH_2OCH_2CH_2-$, $-CH_2CH_2OCH_2CH_2OCH_2CH_2-$, $-(CH_2)_k-$, wherein k is an integer of from about 2 to about 10, and $-CH_2CH(OH)CH_2-$; (c) copolymers of Formula III

III

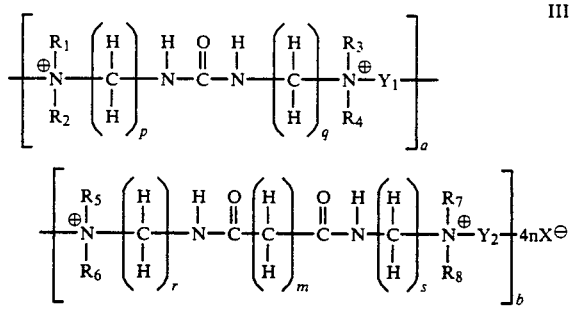

wherein a and b are each integers wherein the sum of a+b is from 2 to about 200, $R_1$, $R_2$, $R_3$, $R_4$, $R_5$, $R_6$, $R_7$, and $R_8$ are each independently selected from the group consisting of alkyl groups, hydroxyalkyl groups, and polyoxyalkylene groups, p is an integer of from 1 to about 10, q is an integer of from 1 to about 10, X is an anion, and $Y_1$ and $Y_2$ are each independently selected from the group consisting of $-CH_2CH_2OCH_2CH_2-$, $-CH_2CH_2OCH_2CH_2OCH_2CH_2-$, $-(CH_2)_k-$, wherein k is an integer of from about 2 to about 10, and $-CH_2CH(OH)CH_2-$; (d) mixtures of polymers of Formula I and polymers of Formula II; (e) mixtures of polymers of Formula I and copolymers of Formula III; (f) mixtures of polymers of Formula II and copolymers of Formula III; and (g) mixture of polymers of Formula I, polymers of Formula II, and copolymers of Formula III; (2) an optional binder polymer; and (3) an optional filler.

2. A recording sheet according to claim 1 wherein the binder polymer is present in the coating in an amount so that the ratio of binder to quaternary ammonium polymer by weight is from about 0.5:1 to about 5:1.

3. A recording sheet according to claim 1 wherein the binder polymer is selected from the group consisting of (a) water soluble polysaccharides and chemical derivatives of polysaccharides; (b) water soluble vinyl polymers; (c) water soluble formaldehyde resins; (d) ionic polymers; (e) latex polymers; (f) water soluble maleic anhydride and maleic acid containing polymers; (g) acrylamide containing polymers; (h) poly (ethylene imine) containing polymers; and mixtures thereof.

4. A recording sheet according to claim 3 wherein the binder polymer is selected from the group consisting of (1) starch, (2) cationic starch, (3) hydroxyalkylstarches, (4) gelatin, (5) alkyl celluloses and aryl celluloses, (6) hydroxy alkyl celluloses, (7) alkyl hydroxy alkyl celluloses, (8) hydroxy alkyl alkyl celluloses, (9) dihydroxyalkyl celluloses, (10) hydroxyalkyl hydroxy alkyl celluloses, (11) chlorodeoxycellulose, (12) amino deoxycellulose, (13) dialkylammonium halide hydroxy alkyl celluloses, (14) hydroxyalkyl trialkyl ammonium halide hydroxyalkyl celluloses, (15) dialkyl amino alkyl celluloses, (16) carboxyalkyl dextrans, (17) dialkyl aminoalkyl dextrans, (18) amino dextran, (19) carboxy alkyl cellulose salts, (20) gum arabic, (21) carrageenan, (22) Karaya gum, (23) xanthan, (24) chitosan, (25) carboxyalkyl hydroxyalkyl guars, (26) cationic guar, (27) n-carboxyalkyl chitins, (28) dialkyl ammonium hydrolyzed collagen proteins, (29) agaragar, (30) cellulose sulfate salts, (31) carboxyalkylhydroxyalkyl cellulose salts, and mixtures thereof.

5. A recording sheet according to claim 3 wherein the binder polymer is selected from the group consisting of (1) poly(vinyl alcohol), (2) poly (vinyl phosphate), (3) poly (vinyl pyrrolidone), (4) vinyl pyrrolidone-vinyl acetate copolymers, (5) vinyl pyrrolidone-styrene copolymers, (6) poly (vinylamine), (7) poly (vinyl alcohol) alkoxylated, (8) poly (vinyl pyrrolidone-dialkylaminoalkyl alkylacrylates), and mixtures thereof.

6. A recording sheet according to claim 3 wherein the binder polymer is selected from the group consisting of (1) melamine-formaldehyde resin, (2) urea-formaldehyde resin, (3) alkylated urea-formaldehyde resins, and mixtures thereof.

7. A recording sheet according to claim 3 wherein the binder polymer is selected from the group consisting of (1) poly (2-acrylamide-2-methyl propane sulfonic acid), (2) poly (N,N-dimethyl-3,5-dimethylene piperidinium chloride), (3) poly (methylene-guanidine) hydrochloride, and mixtures thereof.

8. A recording sheet according to claim 3 wherein the binder polymer is selected from the group consisting of (1) cationic styrene-butadiene latexes, (2) anionic styrene-butadiene latexes, (3) nonionic styrene-butadiene latexes, (4) ethylene-vinylacetate latexes, (5) vinyl acetate-acrylic copolymer latexes, and mixtures thereof.

9. A recording sheet according to claim 3 wherein the binder polymer is selected from the group consisting of (1) styrene-maleic anhydride copolymers, (2) vinyl alkyl ether-maleic anhydride copolymers, (3) alkylene-maleic anhydride copolymers, (4) butadiene-maleic acid copolymers, (5) vinylalkylether-maleic acid copolymers, (6) alkyl vinyl ether-maleic acid esters, and mixtures thereof.

10. A recording sheet according to claim 3 wherein the binder polymer is selected from the group consisting of (1) poly (acrylamide), (2) acrylamide-acrylic acid copolymers, (3) poly (N,N-dimethyl acrylamide), and mixtures thereof.

11. A recording sheet according to claim 3 wherein the binder polymer is selected from the group consisting of (1) poly(ethylene imine), (2) poly(ethylene imine) epichlorohydrin, (3) alkoxylated poly (ethylene imine), and mixtures thereof.

12. A recording sheet according to claim 1 wherein the filler is present in the coating in an amount of from about 1 to about 60 percent by weight.

13. A recording sheet according to claim 1 wherein the coating is present on the substrate in a thickness of from about 0.1 to about 25 microns.

14. A recording sheet according to claim 1 wherein the substrate is paper.

15. A recording sheet according to claim 1 wherein the substrate is a transparency material.

16. A recording sheet according to claim 1 wherein the substrate is a filled plastic.

17. A recording sheet according to claim 1 wherein the substrate has a Hercules internal sizing degree of from about 0.4 to about 5,000 seconds.

18. A recording sheet according to claim 1 wherein the substrate has a porosity value of from about 100 to about 1,260 milliliters per minute.

19. A recording sheet according to claim 1 wherein the substrate has a basis weight of from about 40 to about 400 grams per square meter.

20. A recording sheet according to claim 1 wherein the substrate has a thickness of from about 50 to about 500 microns.

21. A recording sheet according to claim 1 wherein the quaternary ammonium polymer is of Formula I wherein $R_1$, $R_2$, $R_3$, and $R_4$ are all methyl groups, p and q are each 3, n is 6, X is a chlorine anion, and Y is $-CH_2CH_2OCH_2CH_2-$.

22. A recording sheet according to claim 1 wherein the quaternary ammonium polymer is of Formula II wherein $R_5$, $R_6$, $R_7$, and $R_8$ are all methyl groups, r and s are each 3, m is 7, n is 100, X is a chlorine anion, and Y is $-CH_2CH_2OCH_2CH_2-$.

23. A recording sheet according to claim 1 wherein the quaternary ammonium polymer is of Formula II wherein $R_5$, $R_6$, $R_7$, and $R_8$ are all methyl groups, r and s are each 3, m is 4, n is 100, X is a chlorine anion, and Y is $-CH_2CH_2OCH_2CH_2-$.

24. A recording sheet according to claim 1 wherein the quaternary ammonium polymer is of Formula III wherein $R_1$, $R_2$, $R_3$, $R_4$, $R_5$, $R_6$, $R_7$, and $R_8$ are all methyl groups, p, q, r, and s are each 3, m is 4, a is 4, b is 100, X is a chlorine anion, $Y_1$ is $-CH_2CH_2OCH_2CH_2-$, and $Y_2$ is $-CH_2CH_2OCH_2CH_2-$.

25. A recording sheet according to claim 1 wherein the quaternary ammonium polymer is present in an amount of from about 0.05 to about 20 percent by weight of the substrate.

* * * * *